US009285700B2

(12) United States Patent
Kobayashi et al.

(10) Patent No.: US 9,285,700 B2
(45) Date of Patent: Mar. 15, 2016

(54) LIQUID DEVELOPER, PARTICLES FOR LIQUID DEVELOPER, AND LIQUID DEVELOPER ACCOMMODATION CONTAINER

(71) Applicant: FUJI XEROX CO., LTD., Tokyo (JP)

(72) Inventors: Takako Kobayashi, Kanagawa (JP); Daisuke Yoshino, Kanagawa (JP); Akira Imai, Kanagawa (JP); Koji Horiba, Kanagawa (JP); Masahiro Oki, Kanagawa (JP); Hiroyuki Moriya, Kanagawa (JP); Yoshihiro Inaba, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 53 days.

(21) Appl. No.: 14/287,783

(22) Filed: May 27, 2014

(65) Prior Publication Data

US 2015/0147692 A1 May 28, 2015

(30) Foreign Application Priority Data

Nov. 25, 2013 (JP) ..... 2013-243011

(51) Int. Cl.

| | |
|---|---|
| ***G03G 9/13*** | (2006.01) |
| ***G03G 9/125*** | (2006.01) |
| ***G03G 9/135*** | (2006.01) |

(52) U.S. Cl.

CPC ..... *G03G 9/125* (2013.01); *G03G 9/132* (2013.01); *G03G 9/1355* (2013.01)

(58) Field of Classification Search

CPC ..... G03G 9/132; G03G 9/125
USPC ..... 430/114, 115, 116
See application file for complete search history.

(56) References Cited

U.S. PATENT DOCUMENTS

| | | | | |
|---|---|---|---|---|
| 5,604,067 | A | 2/1997 | Nagai et al. | |
| 2011/0045400 | A1 * | 2/2011 | Mitsuzawa ..... | G03G 9/0825 430/112 |
| 2012/0070773 | A1 * | 3/2012 | Kobayashi ..... | G03G 5/08214 430/108.23 |

FOREIGN PATENT DOCUMENTS

| | | |
|---|---|---|
| JP | A-7-319205 | 12/1995 |
| JP | A-2000-330330 | 11/2000 |
| JP | A-2008-201959 | 9/2008 |
| JP | A-2009-288414 | 12/2009 |
| JP | A-2012-256065 | 12/2012 |

* cited by examiner

*Primary Examiner* — Christopher Rodee
(74) *Attorney, Agent, or Firm* — Oliff PLC

(57) ABSTRACT

A liquid developer includes a carrier liquid having silicone oil, and toner particles including a polyester resin and having a value of ammonium ions contained therein measured by underwater extraction in a range of 0.005 ppm to 1 ppm.

9 Claims, 3 Drawing Sheets

LIQUID DEVELOPER, PARTICLES FOR LIQUID DEVELOPER, AND LIQUID DEVELOPER ACCOMMODATION CONTAINER

CROSS-REFERENCE TO RELATED APPLICATIONS

This application is based on and claims priority under 35 USC 119 from Japanese Patent Application No. 2013-243011 filed Nov. 25, 2013.

BACKGROUND

1. Technical Field

The present invention relates to a liquid developer, particles for a liquid developer, and a liquid developer accommodation container.

2. Related Art

Currently, a method of visualizing image information through electrostatic charge image such as an electrophotographic system is used in various fields. In the electrophotographic system, a latent image (electrostatic latent image) is formed on an image holding member by charging and exposing steps (latent image formation step), the electrostatic latent image is developed with a developer for electrostatic charge image development (hereinafter, may be simply referred to as a "developer") including toner for electrostatic charge image development (hereinafter, may be simply referred to as "toner") (development step), and a transfer step and a fixing step are performed, to perform visualization. As the developer used in a dry development method, there are a two-component developer formed of toner and a carrier, and a single-component developer using magnetic toner or non-magnetic toner alone.

Meanwhile, a liquid developer used in a wet development method is obtained by dispersing toner particles in an insulating carrier liquid, and a type obtained by dispersing toner particles including thermoplastic resins in a volatile carrier liquid, and a type obtained by dispersing toner particles including thermoplastic resins in a slightly volatile carrier liquid have been known.

Meanwhile, a method of evaluating an amount of impurities of the liquid developer has also been proposed.

SUMMARY

According to an aspect of the invention, there is provided a liquid developer including:

a carrier liquid having silicone oil; and toner particles including a polyester resin and having a value of ammonium ions contained therein measured by underwater extraction in a range of 0.005 ppm to 1 ppm.

BRIEF DESCRIPTION OF THE DRAWINGS

Exemplary embodiments of the present invention will be described in detail based on the following figures, wherein.

DETAILED DESCRIPTION

Figure 1:
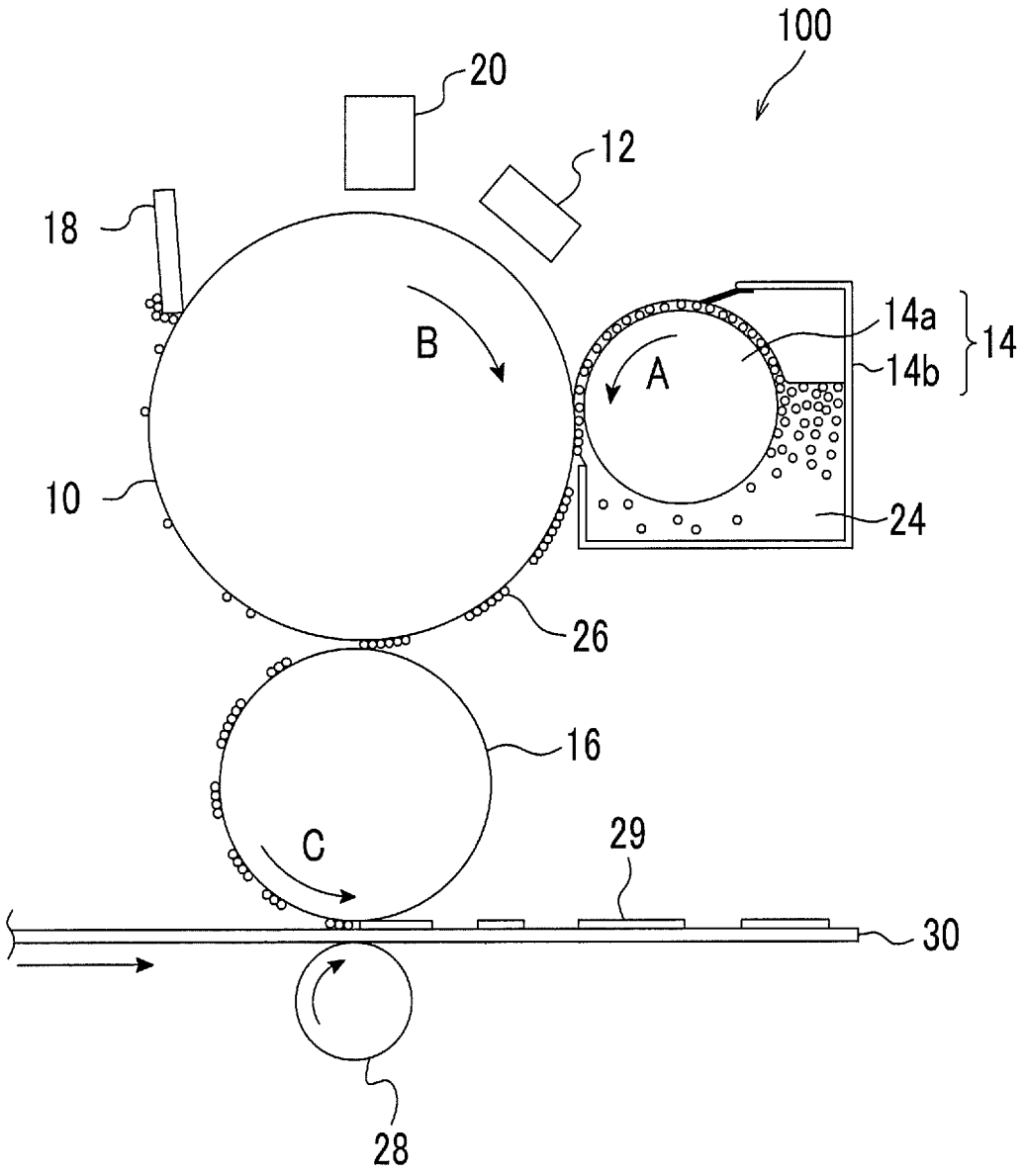
FIG. 1 is a schematic configuration diagram showing an example of an image forming apparatus according to an exemplary embodiment of the invention.

Exemplary embodiments of the invention will be described hereinafter. The exemplary embodiments of the invention are only examples for performing the invention, and the invention is not limited to the exemplary embodiments.

In a liquid developer, toner particles are dispersed in oil which is a carrier liquid, and high-insulating paraffin oil or the like is used as the carrier liquid, in many cases. As the toner particles to be dispersed, particles including a styrene-acrylic resin or a polyester resin used in toner which is used for a general dry developer may be used.

For toner concentration in the liquid developer, solid content concentration equal to or more than 30% by weight is desirable when considering a volume of the liquid developer at the time of storage or an amount of oil remaining in an obtained image, but in contrast, viscosity of the liquid developer is preferably approximately equal to or less than 10,000 mPas, when considering a relationship with a transportation system in an image forming apparatus. The viscosity of the liquid developer increases with an increase in the solid content concentration, and an adjustable range of the solid content concentration has been changed depending on particle sizes of the toner particles or types of the particles. When considering the amount of oil remaining in the image, in a case where paraffin oil having a high boiling point is used as the carrier liquid, since the oil remains in the toner, a problem of storability of the image may occur. Materials of the toner and the carrier to be used have been investigated in view of this problem, and particularly in a technology of using silicone oil as the carrier and using particles including a polyester resin as the toner, plasticization of the toner is suppressed, and therefore the storability of the image tends to be improved.

The inventors have found that a liquid developer having low viscosity and excellent handleability is obtained. The liquid developer is a liquid developer including a carrier liquid having silicone oil as a main component, and obtained by using toner particles containing ammonium ions, having a value of ammonium ions contained therein measured by underwater extraction in a range of 0.005 ppm to 1 ppm, and including a polyester resin.

A liquid developer according to the exemplary embodiment of the invention includes; a carrier liquid having silicone oil as a main component; and toner particles including a polyester resin and having a value of ammonium ions contained therein measured by underwater extraction in a range of 0.005 ppm to 1 ppm.

Particles for a liquid developer according to the exemplary embodiment of the invention are particles which include a polyester resin and have a value of ammonium ions contained therein measured by underwater extraction in a range of 0.005 ppm to 1 ppm. These particles for a liquid developer are particularly useful as toner particles for a liquid developer including the carrier liquid having silicone oil as a main component.

Liquid Developer

In the toner particles included in the liquid developer according to the exemplary embodiment, a value of ammonium ions contained therein measured by underwater extraction is in a range of 0.005 ppm to 1 ppm, and is preferably in a range of 0.01 ppm to 0.5 ppm.

When considering high image quality of the image, a small particle size of the toner is desirable, but in this case, a size of a surface area of the toner particles increases, and therefore viscosity in a dispersion system tends to increase. Since a degree of the increase in viscosity is dependent on not only the particle size, but also an interaction with the particle surface, investigation has been performed while considering that the amount of ammonium ions remaining in the toner affects this interaction. Although this mechanism is not always clear, in the silicone oil, wettability of surface of the silicone oil is considered to be changed depending on the amount of ammonium ions existing in the toner particles, and as the amount of ammonium ions increases, a hydrophilic property of the surface of the toner particles enhances and the wettability with respect to the silicone oil tends to be decreased, and accordingly, the interaction between the toner particles may increase and the viscosity of the liquid developer may be increased.

The amount of ammonium ions existing on the surface of the toner particles is dependent on the particle surface area, but ammonium ions are added for controlling an acid value when preparing the toner particles, in many cases, and it is expected that the ammonium ions move into the toner particles due to the small molecular size thereof. Accordingly, it is found that a liquid developer having low viscosity and excellent handleability is obtained by substantially suppressing an interaction between the toner particles by using toner particles in which a value of an amount of ammonium ions measured by underwater extraction is in a range of 0.005 ppm to 1 ppm.

If the amount of ammonium ions is less than 0.005 ppm, a cohesive force between toner particles may be increased to cause the toner particles to be hardly dispersed in silicone oil, or an excessive load may be applied to the dispersion of the toner particles so that the toner particles are crushed. In addition, if the amount of ammonium ions exceeds 1 ppm, moisture is easily adsorbed to the surface of the toner particles, the interaction between the toner particles occurs, and the viscosity is increased.

In the exemplary embodiment, as will be described later, the amount of ammonium ions included in the toner particles, for example, may be controlled by cleaning conditions or drying conditions when preparing the toner. In addition, the amount of ammonium ions included in the toner particles is measured by a method which will be described later.

Toner Particles

The toner particles included in the liquid developer according to the exemplary embodiment include a binder resin, and if necessary, may include other components such as a colorant, a release agent, and the like.

Binder Resin

The binder resin includes a polyester resin as a main component. The polyester resin is obtained by synthesizing an acid (polyvalent carboxylic acid) component and an alcohol (polyol) component with each other, and in the exemplary embodiment, an "acid-derived constituent component" indicates a constituent moiety which is an acid component before synthesis of the polyester resin, and an "alcohol-derived constituent component" indicates a constituent moiety which is an alcohol component before synthesis of the polyester resin. The main component means that content thereof is equal to or more than 50 parts by weight with respect to 100 parts by weight of the binder resin in the toner particles.

Acid-Derived Constituent Component

The acid-derived constituent component is not particularly limited, and aliphatic dicarboxylic acid and aromatic carboxylic acid are preferably used. Examples of aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecandicarboxylic acid, 1,18-octadecanedicarboxylic acid, and the like, or lower alkyl ester or acid anhydride thereof, but the aliphatic dicarboxylic acid is not limited thereto. Examples of aromatic carboxylic acid include lower alkyl ester or acid anhydride of aromatic carboxylic acids such as terephthalic acid, isophthalic acid, phthalic anhydride, trimellitic anhydride, pyromellitic acid, naphthalene dicarboxylic acid, and the like. In addition, alicyclic carboxylic acids such as cyclohexanedicarboxylic acid are used. In order to have a cross-linked structure or a branched structure for securing an excellent fixing property, it is preferable to use tri- or higher valent carboxylic acid (trimellitic acid or acid anhydride thereof) with dicarboxylic acid in combination. Specific examples of alkenyl succinic acid described above include dodecenylsuccinic acid, dodecylsuccinic acid, stearylsuccinic acid, octylsuccinic acid, octenylsuccinic acid, and the like.

Alcohol-Derived Constituent Component

The alcohol-derived constituent component is not particularly limited, but examples of an aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and the like. In addition, diethylene glycol, triethylene glycol, neopentyl glycol, glycerin, alicyclic diols such as cyclohexane diol, cyclohexanedimethanol, hydrogenated bisphenol A, and the like, aromatic diols such as an ethylene oxide adduct of bisphenol A and a propylene oxide adduct of bisphenol A, and the like are used. In order to have a cross-linked structure or a branched structure for securing an excellent fixing property, tri- or higher valent polyol (glycerin, trimethylolpropane, and pentaerythritol) may be used with a diol in combination.

A preparing method of the polyester resin is not particularly limited, and the polyester resin may be prepared by a general polyester polymerization method of causing an acid component and an alcohol component to react to each other, and for example, direct polycondensation, an ester interchange method, and the like are used, and the polyester resin may be prepared by using the methods depending on the kinds of monomers. A molar ratio (acid component/alcohol component) at the time of causing the acid component and the alcohol component to react to each other is different depending on reaction conditions or the like, and therefore it is not the same at all times, but is normally approximately 1/1.

The preparation of the polyester resin, for example, may be performed at a polymerization temperature of 180° C. to 230° C., and pressure in a reaction system may be reduced if necessary, and the reaction may be performed while removing water or alcohol generated at the time of condensation. In a case where the monomer is not dissolved or compatibilized at the reaction temperature, the polymerization reaction may proceed partially fast or partially slow and a large amount of non-colored particles may occur, and therefore a solvent having a high boiling point may be added and dissolved as a solubilizer. The polycondensation reaction may be performed while removing the solubilizer solvent. In a case where the monomer having poor compatibility exists in the copolymerization reaction, the monomer having poor compatibility and acid or alcohol to be subjected to polycondensation with the monomer are condensed in advance, and then the polycondensation may be performed with the main component.

Examples of a catalyst which may be used when preparing the polyester resin include: alkali metal compounds such as sodium, lithium, and the like; alkaline earth metal compounds such as magnesium, calcium, and the like; metal compounds such as zinc, manganese, antimony, titanium, tin, zirconium, germanium, and the like; phosphorous acid compounds; phosphoric acid compounds; amine compounds; and the like. Among them, for example, tin-containing catalysts such as tin, tin formate, tin oxalate, tetraphenyl tin, dibutyl tin dichloride, dibutyl tin oxide, diphenyl tin oxide, and the like are preferably used.

In the exemplary embodiment, a compound including a hydrophilic polar group may be used as long as it can be copolymerized as a resin for the toner for electrostatic charge image development. As a specific example, if the resin to be used is polyester, a dicarboxylic acid compound such as sulfonyl-terephthalic acid sodium salt or 3-sulfonyl isophthalic acid sodium salt in which an aromatic ring is directly substituted with a sulfonyl group, is used.

A weight-average molecular weight Mw of the polyester resin is preferably equal to or more than 5,000 and more preferably in a range of 5,000 to 50,000. If this polyester resin is included, an excellent friction-sliding property is obtained. If the weight-average molecular weight Mw of the polyester resin is lower than 5,000, since separation easily occurs according to the circumstances, problems (filming, fine powder increase due to brittleness, degradation of a powder flow property, and the like) derived by the free resin may occur.

In the toner according to the exemplary embodiment, a resin other than the polyester resin may be included. The resin other than the polyester resin is not particularly limited, and specific examples thereof include: styrenes such as styrene, p-chlorostyrene, α-methyl styrene, and the like; acrylic monomers such as methyl acrylate, ethyl acrylate, n-propyl acrylate, butyl acrylate, lauryl acrylate, 2-ethylhexyl acrylate, and the like; methacrylic monomers such as methyl methacrylate, ethyl methacrylate, n-propyl methacrylate, lauryl methacrylate, 2-ethylhexyl methacrylate, and the like; ethylenic unsaturated acid monomers such as acrylic acid, methacrylic acid, sodium styrene sulfonate, and the like; vinyl nitriles such as acrylonitrile, methacrylonitrile, and the like; vinyl ethers such as vinyl methyl ether, vinyl isobutyl ether, and the like; vinyl ketones such as vinyl methyl ketone, vinyl ethyl ketone, vinyl isopropenyl ketone, and the like; a homopolymer of olefin monomers such as ethylene, propylene, butadiene, and the like, a copolymer obtained by combining two or more kinds of the monomers, or a mixture thereof; epoxy resins; polyester resins; polyurethane resins; polyamide resins; cellulose resins; polyether resins; non-vinyl condensation resins or a mixture of these resins and the vinyl resins; a graft polymer obtained by polymerizing a vinyl monomer in the coexistence of these components. These resins may be used alone or in combination of two or more kinds.

Content of the binder resin is, for example, in a range of 50% by weight to 99% by weight with respect to the entire toner particles.

The toner particles according to the exemplary embodiment, if necessary, may include other additives such as a colorant, a release agent, a charge-controlling agent, silica powder, metal oxide, and the like. These additives may be internally added by kneading with the binder resin, or may be externally added by performing a mixing process after obtaining the toner particles as particles.

The colorant is not particularly limited, and a well-known pigment is used, and if necessary, a well-known dye may be included. In detail, yellow, magenta, cyan, and black pigments which will be described later are used.

As the yellow pigment, a compound represented by a condensed azo compound, an isoindolinone compound, an anthraquinone compound, an azo metal complex compound, a methine compounds, or an allyl amide compound is used.

As the magenta pigment, a condensed azo compound, a diketopyrrolopyrrole compound, anthraquinone compound, quinacridone compounds, a basic dye lake compound, a naphthol compound, a benzimidazolone compound, a thioindigo compound, or perylene compound is used.

As the cyan pigment, a copper phthalocyanine compound and derivatives thereof, an anthraquinone compound, or a basic dye lake compound is used.

As the black pigment, carbon black, aniline black, acetylene black, or iron black is used.

Content of the colorant is, for example, in a range of 1% by weight to 50% by weight with respect to the entire toner particles.

The release agent is not particularly limited, and examples thereof include: vegetable wax such as carnauba wax, Japan wax, rice bran wax, and the like; animal wax such as honey wax, insect wax, whale wax, wool wax, and the like; mineral wax such as montan wax, ozocerite, and the like; synthetic fatty acid solid ester wax such as Fischer Tropsch Wax (FT wax) including ester in a side chain, special fatty acid ester, polyol ester, and the like; and synthetic wax such as paraffin wax, polyethylene wax, polypropylene wax, polytetrafluoroethylene wax, polyamide wax, and silicone compound. The release agent may be used alone or in combination of two or more kinds.

Content of the release agent is, for example, in a range of 1% by weight to 20%; by weight with respect to the entire toner particles.

The charge-controlling agent is not particularly limited, and a well-known charge-controlling agent in the related art is used. Examples thereof include positive charge type charge-controlling agent such as a nigrosine dye, a fatty acid-modified nigrosine dye, a carboxyl group-containing fatty acid-modified nigrosine dye, quaternary ammonium salt, an amine compound, an amide compound, an imide compound, an organic metallic compound, and the like; and negative charge type charge-controlling agent such as a metal complex of oxycarboxylic acid, a metal complex of an azo compound, a metal complex salt dye or salicylic acid derivatives, and the like. The charge-controlling agent may be used alone or in combination of two or more kinds.

The metal oxide is not particularly limited, and examples thereof include titanium oxide, aluminum oxide, magnesium oxide, zinc oxide, strontium titanate, barium titanate, magnesium titanate, calcium titanate, and the like. The metal oxide may be used alone or in combination of two or more kinds.

Method for Preparing Toner Particles

The method for preparing the toner particles used in the exemplary embodiment is not particularly limited, and for example, the toner particles are obtained by pulverizing toner prepared by a preparing method of grinded toner, liquid-emulsified and dried toner, or polymerized toner in the carrier liquid.

For example, the binder resin, if necessary, the colorant and other additives are put in a mixing device such as a Henschel mixer and mixed with each other, and this mixture is melted and kneaded with a twin screw extruder, a Banbury mixer, a roll mill, a kneader, or the like, then is cooled with a drum flaker or the like, is coarse-grinded with a grinder such as a hammer mill or the like, is further pulverized with a pulverizer such as jet mill or the like, and is classified by using an air classifier or the like, to obtain pulverized toner.

In addition, the binder resin, if necessary, the colorant and other additives are dissolved in a solvent such as ethyl acetate, and are emulsified and caused to be suspended in water to which a dispersion stabilizer such as calcium carbonate is added, the solvent is removed, and then particles obtained by removing the dispersion stabilizer is filtered and dried, to obtain liquid-emulsified and dried toner.

Further, a composition including a polymerizable monomer for forming the binder resin, the colorant, a polymerization initiator (for example, benzoyl peroxide, lauroyl peroxide, isopropyl peroxy carbonate, cumene hydroperoxide, 2,4-dichloride benzoyl peroxide, methylethylketone peroxide, and the like), and other additives, is added into an aqueous phase while stirring, and is granulated, is subjected to the polymerization reaction, and then the particles are filtered and dried, to obtain polymerized toner.

A combination ratio of each material (the binder resin, the colorant, and other additives) when obtaining the toner may be set by considering a required property, a low-temperature fixing property, a color, and the like. The obtained toner is pulverized in carrier oil by using a well-known pulverizer such as a ball mill, a bead mill, or a high-pressure wet pulverization machine, to obtain toner particles for a liquid developer of the exemplary embodiment.

As described above, the amount of ammonium ions included in the toner particles may be controlled by cleaning conditions or drying conditions when preparing the toner. The ammonium ions are supplied by ammonia water used when preparing the toner, but the amount thereof may be controlled to be in a range of the desired amount, by removing with a method of using ultrasonic dispersion when cleaning, cleaning with a large amount of pure water, cleaning with ultrapure water which is heated to 40° C. or higher, for example, or using vacuum drying when drying.

Properties of Toner Particles

A volume average particle size D50v of the toner particles is preferably from 1.0 μm to 5.0 μm. By setting the volume average particle size thereof in the range described above, an adhesive force is increased and a developing property is improved. In addition, resolution of an image is also improved. The volume average particle size D50v of the toner particles is more preferably in a range of 1.0 μm to 4.0 μm and even more preferably in a range of 1.0 μm to 3.0 μm. In the liquid developer according to the exemplary embodiment, a liquid developer having low viscosity and excellent handleability is obtained even in a case where the volume average particle size of the toner particles is in a range of 1.0 μm to 5.0 μm. If the volume average particle size D50v of the toner particles exceeds 5.0 μm, an increase in viscosity of the liquid developer is suppressed, but the liquid developer is deteriorated from the point of high image quality.

When considering high image quality of the image and safety, a small particle size of the toner is preferable, but in this case, a size of a surface area of the toner particles increases, and therefore viscosity in a dispersion system tends to increase. In a case where the carrier liquid is silicone oil, dispersibility improvement due to addition of a general surfactant is difficult, unlike particle dispersion in the general solvent system.

The volume average particle size D50v, a number average particle size distribution index (GSDp), and a volume average particle size distribution index (GSDv) of the toner particles are measured by using a laser diffraction/scattering type particle size distribution measuring device, for example, LA920 (manufactured by HORIBA, Ltd.). Cumulative distribution of a volume and a size with respect to a particle size range (channel) divided based on the particle size distribution is drawn from a small size side, and a particle size reaching a cumulative 16% is defined to have the volume D16v and the number D16p, a particle size reaching cumulative 50% is defined to have the volume D50v and the number D50p, and a particle size reaching cumulative 84% is defined to have the volume D84v and the number D84p. By using these, the volume average particle size distribution index (GSDv) is calculated as $(D84v/D16v)^{1/2}$, and the number average particle size distribution index (GSDp) is calculated as $(D84p/D16p)^{1/2}$.

Carrier Liquid

The carrier liquid is insulating liquid for dispersing the toner particles, and silicone oil having larger than 20 degrees of polymerization of dimethyl silicone, diphenyl silicone, and a hydrogen-modified silicone compound, silicone oil such as acyclic siloxane compound (silicone solvent) are used. Among them, dimethyl silicone is preferable from viewpoints of viscosity and dispersibility. "To have silicone oil as a main component" means to include 50% by weight or more of silicone oil in the carrier liquid.

The carrier liquid included in the liquid developer according to the exemplary embodiment may be used alone or in combination of two or more kinds. Ina case of using the carrier liquid as a mixing system of two or more kinds, a mixed system of the silicone solvent and vegetable oil is used, for example.

Volume resistivity of the carrier liquid is, for example, in a range of $1.0\times10^{10}$ Ω·cm to $1.0\times10^{14}$ Ω·cm and may be in a range of $1.0\times10^{12}$ Ω·cm to $1.0\times10^{14}$ Ω·cm.

Viscosity of the carrier liquid is steady shear viscosity at 25° C., and is preferably in a range of 1 mPas to 100 mPas. The viscosity thereof is more preferably in a range of 1 mPas to 80 mPas and is even more preferably in a range of 1 mPas to 60 mPas. If the steady shear viscosity is smaller than 1 mPas, molecular weight of the silicone oil may be decreased. If the steady shear viscosity is greater than 100 mPas, the viscosity of the developer using this carrier oil is increased, and accordingly a required property may not be obtained.

The carrier liquid may include various secondary materials, for example, a dispersant, an emulsifier, a surfactant, a stabilizer, a wetting agent, a thickener, a foaming agent, a anti-foam agent, a coagulating agent, a gelling agent, an anti-settling agent, a charge-controlling agent, an anti-static agent, an age resister, a softener, a plasticizer, a filler, an odorant, an antitack agent, a release agent, and the like.

Preparing Method of Liquid Developer

The liquid developer according to the exemplary embodiment is obtained by mixing and pulverizing the toner particles and the carrier liquid, for example, by using a dispersing machine such as a ball mill, a sand mill, an attritor, or a bead mill to disperse the toner particles in the carrier liquid. The dispersion of the toner particles in the carrier liquid is not limited to being performed with the dispersing machine, and dispersion may be performed by rotating special stirring blades at a high rate, as a mixer, dispersion may be performed by a shear force of rotor/stator known as a homogenizer, or the dispersion may be performed by ultrasonic waves.

Concentration of the toner particles in the carrier liquid is preferably in a range of 0.5% by weight to 50% by weight and more preferably in a range of 1% by weight to 40% by weight, from a viewpoint of appropriate control of the viscosity of the developer, and smooth circulation of a developer in a developing machine.

After that, the obtained dispersion may be filtered using a filter such as a film filter having a mesh size of 100 μm, for example, and dust and coarse particles may be removed.

Developer Cartridge, Process Cartridge, and Image Forming Apparatus

An image forming apparatus according to the exemplary embodiment, for example, includes: an image holding member (hereinafter, may be referred to as a "photoreceptor"); a charging unit that charges a surface of the image holding member; a latent image forming unit that forms a latent image (electrostatic latent image) on the surface of the image holding member; a developing unit that develops the latent image formed on the surface of the image holding member with the liquid developer according to the exemplary embodiment held on the surface of a developer holding member, and forms a toner image; a transfer unit that transfers the toner image formed on the surface of the image holding member on a recording medium; and a fixing unit that fixes the toner image transferred to the recording medium onto the recording medium to form a fixed image.

In the image forming apparatus, a part including the developing unit, for example, may have a cartridge structure (process cartridge) which is detachable from an image forming apparatus main body. This process cartridge is not particularly limited as long as the liquid developer according to the exemplary embodiment is accommodated therein. The process cartridge, for example, accommodates the liquid developer according to the exemplary embodiment, includes the developing unit that develops the latent image formed on the image holding member with the liquid developer, and forms the toner image, and is detachable from the image forming apparatus.

A developer cartridge (container) according to the exemplary embodiment is not particularly limited as long as the liquid developer according to the exemplary embodiment is accommodated therein. The developer cartridge, for example, accommodates the liquid developer according to the exemplary embodiment, includes the developing unit that develops the latent image formed on the image holding member with the liquid developer, and forms the toner image, and is detachable from the image forming apparatus.

Hereinafter, the image forming apparatus using the liquid developer of the exemplary embodiment will be described with reference to the drawings.

FIG. 1 is a schematic configuration diagram showing an example of the image forming apparatus according to the exemplary embodiment. An image forming apparatus 100 is configured to include a photoreceptor (image holding member) 10, a charging device (charging unit) 20, an exposing device (latent image forming unit) 12, a developing device (developing unit) 14, an intermediate transfer member (transfer unit) 16, a cleaner (cleaning unit) 18, and a transfer fixing roll (transfer unit and fixing unit) 28. The photoreceptor 10 has a cylindrical shape, and the charging device 20, the exposing device 12, the developing device 14, the intermediate transfer member 16, and the cleaner 18 are provided in this order, on an outer periphery of the photoreceptor 10.

Hereinafter, an operation of this image forming apparatus 100 will be described.

The charging device 20 charges a surface of the photoreceptor 10 to a predetermined potential (charging step), and the exposing device 12 exposes the charged surface, for example, by a laser beam to form a latent image (electrostatic latent image) based on an image signal (latent image forming step).

The developing device 14 is configured to include a developing roller 14*a* and a developer accommodation container 14*b*. The developing roller 14*a* is provided so that a part thereof is immersed in a liquid developer 24 accommodated in the developer accommodation container 14*b*. The liquid developer 24 includes an insulating carrier liquid, toner particles including a binder resin, and the charge-controlling agent.

The toner particles are dispersed in the liquid developer 24, but variation between positions in concentration of toner particles in the liquid developer 24 is decreased, for example, by continuing to stirr the liquid developer 24 by a stirring member further provided in the developer accommodation container 14*b*. Accordingly, the liquid developer 24 having the decreased variation in concentration of the toner particles is supplied to the developing roller 14*a* which rotates in an arrow A direction of the drawing.

The liquid developer 24 supplied to the developing roller 14*a* is carried to the photoreceptor 10 in a state that supply thereof is limited to a given amount by a regulating member, and is supplied to the electrostatic latent image at a location where the developing roller 14*a* and the photoreceptor 10 approach each other (or come in contact with each other). Accordingly, the electrostatic latent image is developed to be a toner image 26 (developing step).

The developed toner image 26 is carried to the photoreceptor 10 which rotates in an arrow B direction of the drawing and is transferred to a sheet (recording medium) 30, but in the exemplary embodiment, in order to improve transfer efficiency to the recording medium including peeling efficiency of the toner image from the photoreceptor 10 and to further perform the fixing at the same time as the transfer to the recording medium, the toner image is temporarily transferred to the intermediate transfer member 16 before transferring to the sheet 30 (intermediate transfer step). At that time, a difference in peripheral speeds may be provided between the photoreceptor 10 and the intermediate transfer member 16.

Next, the toner image carried in an arrow C direction by the intermediate transfer member 16 is transferred and fixed to the sheet 30 in a position in contact with the transfer fixing roll 28 (transfer step and fixing step). The transfer fixing roll 28 sandwiches the sheet 30 with the intermediate transfer member 16, and brings the toner image on the intermediate transfer member 16 into tight contact with the sheet 30. Accordingly, the toner image is transferred to the sheet 30, and the toner image is fixed onto the sheet to be a fixed image 29. It is preferable to perform the fixation of the toner image by pressurizing and heating by providing a heating element on the transfer fixing roll 28. A fixing temperature is generally in a range of 120° C. to 200° C.

If the intermediate transfer member 16 has a roll shape as shown in FIG. 1, since it configures a roll pair with the transfer fixing roll 28, the intermediate transfer member 16 and the transfer fixing roll 28 have a configuration similar to that of a fixing roll and a pressurizing roll of the fixing device, respectively, to exhibit fixing functions. That is, when the sheet 30 passes through a nip formed between the intermediate transfer member 16 and the transfer fixing roll 28, the toner image is transferred and is heated and pressurized with respect to the intermediate transfer member 16 by the transfer fixing roll 28. Accordingly, the binder resin in the toner particles configuring the toner image is softened, the toner image is permeated into fiber of the sheet 30, and the fixed image 29 is formed on the sheet 30.

The transfer and the fixation to the sheet 30 are performed at the same time in the exemplary embodiment, but the fixation may be performed after the transfer, by treating the transfer step and the fixing step as different steps. In this case, the transfer roll which transfers the toner image from the photoreceptor 10 has a function similar to that of the intermediate transfer member 16.

Meanwhile, in the photoreceptor 10 which transfers the toner image 26 to the intermediate transfer member 16, the toner particles not transferred and remaining thereon are carried to a position in contact with the cleaner 18 and are collected by the cleaner 18. In a case where the transfer efficiency is nearly 100% and residual toner is not problematic, the cleaner 18 may not be provided.

The image forming apparatus 100 may further include an erasing device (not shown) which erases the surface of the photoreceptor 10 after transfer and before the next charging.

All of the charging device 20, the exposing device 12, the developing device 14, the intermediate transfer member 16, the transfer fixing roll 28, and the cleaner 18 included in the image forming apparatus 100 may be operated in synchronous manner with a rotating rate of the photoreceptor 10, for example.

Figure 2:
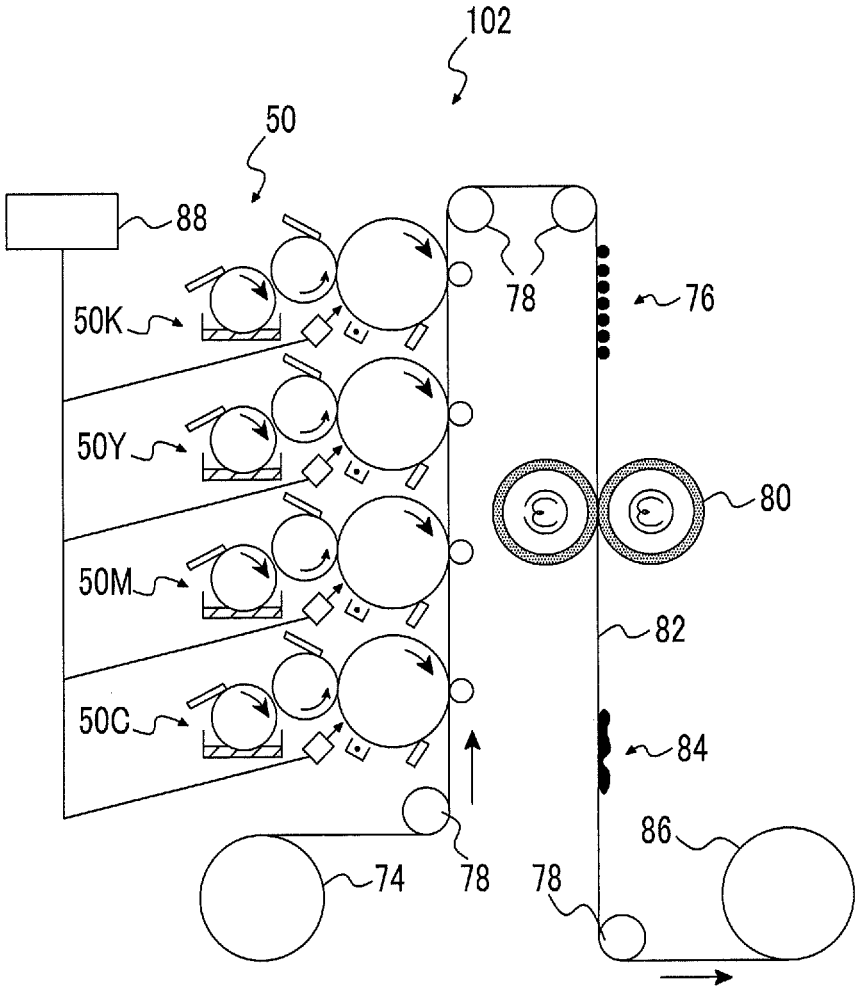
FIG. 2 is a schematic configuration diagram showing another example of an image forming apparatus according to an exemplary embodiment of the invention.
Figure 3:
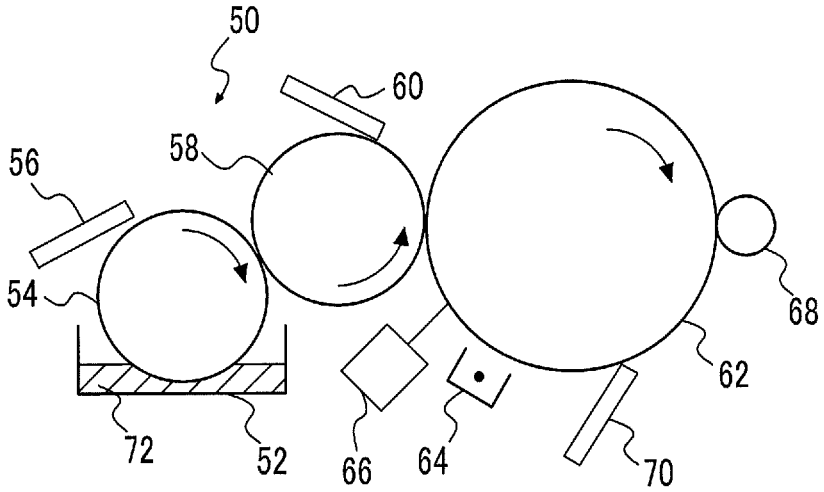
FIG. 3 is a schematic configuration diagram showing an enlarged portion of a developing device of FIG. 2.

The outline of the other example of the image forming apparatus for a liquid developer according to the exemplary embodiment is shown in FIG. 2, and an enlarged view of a part of the developing device 50 is shown in FIG. 3, but the exemplary embodiment is not limited to the configurations of FIGS. 2 and 3.

As shown in FIG. 2, an image forming apparatus 102 includes a developing device 50 as a developing unit including a black developing device 50K, a yellow developing device 50Y, a magenta developing device 50M, and a cyan developing device 50C. As shown in FIG. 3, the image forming apparatus 102 includes the developing device 50, a photoreceptor 62, a charging device 64 as a charging unit, an exposing device 66 as a latent image forming unit, a transfer device 68 as a transfer unit, and a cleaner 70 as a photoreceptor cleaning unit. The developing device 50 includes a developer tank 52, a developer supply roll 54, a developer supply amount restriction unit 56, a developing roller 58, and a developing roller cleaner 60.

An operation of the image forming apparatus 102 will be described with reference to FIGS. 2 and 3. Image forming processes such as image formation, development, sheet transportation, fixation, and the like are performed by image forming commands from a host computer or the like (not shown). In FIG. 3, the surface of the photoreceptor 62 is charged by the charging device 64 so as to have a predetermined charged bias amount (charging step), and an electrostatic latent image is formed on the surface of the photoreceptor 62 by a light beam or the like from the exposing device 66, based on information obtained by processing an image signal transmitted from a host computer or the like by an image signal operation unit 88 shown in FIG. 2 (latent image forming step).

A predetermined amount of the liquid developer 72 in which the toner particles are dispersed in the carrier liquid, is maintained by a developer calculation unit (not shown), and is carried to the developing roller 58 from the developer tank 52 by the developer supply roll 54. The developer supply roll 54 uses a system of charging the surface to attach the developer with an electrostatic force, or a system of providing a groove or a recess on the roll and carrying the liquid so as to lading the liquid, and a carrying amount is restricted to a predetermined amount by the developer supply amount restriction unit 56. The developer on the developing roller is transferred to the photoreceptor 62 based on the electrostatic latent image (developing step), and unnecessary developer is returned to the developer tank 52 by the developing roller cleaner 60 and the developer circulation unit (not shown).

The developer formed on the surface of the photoreceptor 62 is transferred to a sheet 82 as a recording medium shown in FIG. 2 by the transfer device 68 (transfer step). The sheet 82 is, for example, continuous sheet, and the sheet 82 supplied from a roll sheet supply unit 74 is stretched on a tension roll 78 and is transported to a winding unit 86 by a sheet driving unit (not shown). The winding unit 86 is not compulsory, and a post-processing step such as cutting or bookbinding may be provided. Each of the cyan, magenta, yellow, and black developers are transferred in this order to the sheet 82 with an electrostatic force, pressure, or the like, by the transfer device 68. For example, a difference in set potentials is provided in the transfer device 68 of each color, and transfer of the upstream developer to a unit of other color is prevented when performing color superimposing. Almost of the developer on the photoreceptor 62 is transferred to the sheet 82, but slight residual developer is removed by the cleaner 70 (photoreceptor cleaning step).

A toner image 76 formed on the sheet 82 is fixed by a fixing device 80 to be a fixed image 84. The fixing device 80, for example, include a pair of fixing rolls in which an elastic rubber is formed on a metal roll, a release layer for the release is further formed on the surface of the elastic rubber, and which sandwich the sheet 82 by a pressurizing mechanism (not shown) so as to obtain predetermined pressure and nip width. The fixing device 80 may use a fixing system of applying an energy to a toner image without direct contact, such as a system of radiating a far-infrared light or laser light, a system of blowing hot air or vapor, or a system of bringing a heating member into contact with a rear surface of the sheet. In addition, the fixing device may be used with another fixing unit or may include a plurality of the pairs of fixing rollers.

EXAMPLES

Hereinafter, the invention will be described in more detail with examples and comparative examples, but the invention is not limited to the following examples.

Preparation of Toner Particles

Toner of the example is obtained by the following method. That is, the following resin particle dispersion, colorant dispersion, and release agent dispersion are prepared, respectively. Next, while mixing and stirring predetermined amounts thereof, a polymer of inorganic metal salt is added thereto, neutralized in an ion manner, to form an aggregate of respective particles described above, and a desirable toner particle size is obtained. Then, after adjusting pH in a system in a range of from mild acidity to neutrality by inorganic hydroxide, heating is performed at a temperature equal to or higher than a glass transition temperature of the resin particle, and coalescence and aggregation are performed. After completing the reaction, steps of sufficient cleaning, solid-liquid separation, and drying are performed to obtain desired toner.

Synthesis of Crystalline Polyester Resin 1982 parts by weight of sebacic acid, 1490 parts by weight of ethylene glycol, 59.2 parts by weight of sodium dimethyl 5-sulphonatoisophthalate, and 0.8 part by weight of dibutyl tin oxide are reacted in a flask under a nitrogen atmosphere at 180° C. for 5 hours, and then condensation reaction is performed at 220° C. under reduced pressure. During the reaction, a polymer is sampled, and when the molecular weight of Mw (weight-average molecular weight) is 20,000 and Mn (number average molecular weight) is 8,500 by gel permeation chromatography (GPC), the reaction is stopped and a crystalline polyester resin is obtained. A dissolution temperature (peak temperature of DSC) measured by using a differential scanning calorimeter (DSC, manufactured by Shimadzu Corporation, DSC-50 type) is 71° C. A measurement result of content of sodium dimethyl 5-sulphonatoisophthalate by an NMR is 1 mol % (with respect to the entire constituent components).

Crystalline Polyester Resin Particle Dispersion 160 parts by weight of crystalline polyester resin, 233 parts by weight of ethyl acetate, and 3.5 parts by weight of 10% by weight ammonia aqueous solution are prepared, put into a separable flask, heated at 75° C., and stirred by a three-one motor (manufactured by Shinto Scientific Co., Ltd.) to prepare a resin mixture. While further stirring this resin mixture, 373 parts by weight of ion exchange water is slowly added thereto, the resin mixture is subjected to phase-transfer emulsification, a temperature thereof is decreased to 40° C. at a temperature-decreasing rate of 10° C./min, and the solvent is removed to obtain a crystalline polyester resin particle dispersion (solid content concentration: 30% by weight).

Synthesis of Amorphous Polyester Resin

After 200 parts by weight of dimethyl terephthalate, 85 parts by weight of 1,3-butanediol, 0.3 part by weight of dibutyl tin oxide as a catalyst are put into a heated and dried two-necked flask, air in the container is converted into an inert atmosphere by nitrogen gas by a depressurization operation, and stirring is performed with mechanical stirring at 180 rpm for 5 hours. After that, the temperature thereof is slowly increased to 230° C. under reduced pressure, the mixture is stirred for 2 hours and cooled when it is in a viscous state, the reaction is stopped, and 240 parts by weight of amorphous polyester resin (amorphous polyester resin including the acid-derived constituent component in which content of constituent component derived from aromatic dicarboxylic acid is 100 configuration mol % and the alcohol-derived constituent component in which content of constituent component derived from an aliphatic diol is 100 configuration mol %) is synthesized.

As a result of molecular weight measurement (polystyrene conversion) performed by GPC, the weight-average molecular weight (Mw) of the obtained amorphous polyester resin (1) is 9,500 and the number average molecular weight (Mn) thereof is 4,200. In addition, when a DSC spectrum of the amorphous polyester resin (1) is measured by using the differential scanning calorimeter (DSC) described above, a clear peak is not shown and a stepwise change in an endothermic energy amount is observed. A glass transition temperature which is a center point of the stepwise change in an endothermic energy amount is 55° C. A resin acid value is 18 mgKOH/g.

Amorphous Polyester Resin Particle Dispersion 160 parts by weight of the amorphous polyester resin (1), 233 parts by weight of ethyl acetate, and 3.5 parts by weight of 10% by weight ammonia aqueous solution are prepared, put into a separable flask, heated at 70° C., and stirred by a three-one motor (manufactured by Shinto Scientific Co., Ltd.) to prepare a resin mixture. While further stirring this resin mixture, 373 parts by weight of ion exchange water is slowly added thereto, the resin mixture is subjected to phase-transfer emulsification, a temperature thereof is decreased to 40° C. at a temperature-decreasing rate of 1° C./min, and the solvent is removed to obtain an amorphous polyester resin particle dispersion (solid content concentration: 30% by weight).

Preparation of Colorant Dispersion

| | |
|---|---|
| Cyan pigment (C.I. Pigment Blue 15:3, manufactured by Dainichiseika Color & Chemicals Mfg. Co., Ltd.) | 45 parts by weight |
| Ionic surfactant (NEOGEN RK manufactured by Dai-Ichi Kogyo Seiyaku Co., Ltd.) | 5 parts by weight |
| Ion exchange water | 200 parts by weight |

The above components are mixed and dissolved in each other, and dispersed with a homogenizer (ULTRA-TURRAX T50 manufactured by IKA Ltd.) for 10 minutes, to obtain a colorant dispersion having volume average particle size of 170 nm and solid content concentration of 27.0% by weight.

Preparation of Release Agent Dispersion

| | |
|---|---|
| Alkyl wax (FNP0085, melting temperature of 86° C., manufactured by Nippon Seiro Co., Ltd. ) | 45 parts by weight |
| Anionic surfactant (NEOGEN RK manufactured by Dai-Ichi Kogyo Seiyaku Co., Ltd. ) | 5 parts by weight |
| Ion exchange water | 200 parts by weight |

The above components are heated to 90° C., sufficiently dispersed with ULTRA-TURRAX T50 manufactured by IKA Ltd. and subjected to a dispersion process with a pressure discharge type Gaulin homogenizer, to obtain a release agent dispersion having volume average particle size of 200 nm and solid content concentration of 24.3% by weight.

Preparation of Toner Particles 1

| | |
|---|---|
| Crystalline polyester resin particle dispersion | 15 parts by weight |
| Amorphous polyester resin particle dispersion | 80 parts by weight |
| Colorant dispersion | 18 parts by weight |
| Release agent dispersion | 18 parts by weight |

Ion exchange water is added to the above components so as to have solid content concentration of 16% by weight, and the components are sufficiently mixed and dispersed with ULTRA-TURRAX T50 in a stainless-steel circular flask. Next, 0.36 part by weight of polyaluminum chloride is added thereto and a dispersion operation is continued with ULTRA-TURRAX. The mixture is heated to 47° C. while stirring the flask in an oil bath for heating. After holding the mixture at 47° C. for 60 minutes, 46 parts by weight of the amorphous polyester resin particle dispersion is gently added thereto. Then, after adjusting pH in a system to 9.0 with aqueous sodium hydroxide of 0.55 mol/L, the stainless-steel flask is tightly closed, the mixture is heated to 90° C. while continuing to stirring using a magnetic seal and is held for 3.5 hours.

After completing the above processes, the mixture is cooled, filtered, and sufficiently cleaned by ion exchange water to perform solid-liquid separation by Nutsche type suction filtration. This is further dispersed again in 3,000 parts by weight of ion exchange water at 40° C., is subjected to ultrasonic irradiation at 40° C. for 20 minutes using a heater-attached ultrasonic cleaning device (UT-306H manufactured by SHARP CORPORATION, oscillating frequency of 37 kHz), is stirred at 300 rpm for 15 minutes, and is cleaned. This process is repeated 5 more times, and when electrical conductivity of the filtered solution is 9.7 μS/cm, the solid-liquid separation is performed using No. 4A filter paper by Nutsche type suction filtration, and the resultant material is subjected to freeze-drying to obtain toner particles 1. When a particle size is measured using Coulter Counter (manufactured by Beckman Coulter, Inc., Multisizer III), a volume average particle size is 2.7 μm.

Toner Particles 2

Toner particles 2 having volume average particle size of 3.0 μm are prepared in the same manner as in the toner particles 1, except for setting a cleaning temperature when preparing the toner to 50° C. and repeating cleaning until the electrical conductivity of the filtered solution becomes 3.0 μS/cm.

Toner Particles 3

Toner particles 3 having volume average particle size of 5.5 μm are prepared in the same manner as in the toner particles 1, except for setting the solid content concentration when preparing the toner to 13% by weight.

Toner Particles 4

Toner particles 4 having volume average particle size of 0.9 μm are prepared in the same manner as in the toner particles 1, except for setting the solid content concentration when preparing the toner to 17% by weight and setting the holding time to 45 minutes.

Toner Particles 5

Toner particles 5 having volume average particle size of 2.6 μm are prepared in the same manner as in the toner particles 1, except for using ultrapure water at 25° C. in cleaning of particles when preparing the toner.

Toner Particles 6

Toner particles 6 having volume average particle size of 2.6 μm are prepared in the same manner as in the toner particles 1, except for using ultrapure water at 25° C. in cleaning of particles and not performing ultrasonic cleaning when preparing the toner.

Toner Particles 7

Toner particles 7 having volume average particle size of 2.7 μm are prepared in the same manner as in the toner particles 1, except for using ultrapure water at 50° C. in cleaning of particles when preparing the toner, repeating cleaning until the electrical conductivity of the filtered solution becomes 1.0 μS/cm, performing freeze-drying, and then performing vacuum drying at a temperature of 40° C. for 3 days.

PREPARATION OF LIQUID DEVELOPER

Example 1

70 parts by weight of silicone oil KF-96 20cs (manufactured by Shin-Etsu Chemical Co., Ltd.) and 30 parts by weight of toner particles 1 are mixed with each other, dispersed with a homogenizer, to manufacture a liquid developer of Example 1 in which cyan toner is dispersed. When measurement is performed using an E-type viscometer, steady shear viscosity of the silicone oil used at 25° C. is 17 mPas.

The toner particles may be sampled by the following method from the liquid developer. The liquid developer is precipitated by centrifugal separation (1,000 rpm×5 minutes), a supernatant solution is removed by decantation, and the toner particles are extracted. The extracted toner particles are cleaned with hexane or Isoper or the like (mixed solvent may be suitably changed in accordance with the toner resin).

Examples 2 to 8

The liquid developers are prepared with the compositions shown in Table 1 in the same manner as Example 1. For all of the silicone oil, the products of KF-96 series (manufactured by Shin-Etsu Chemical Co., Ltd.), which have different viscosities, are used.

Example 9

The liquid developer is prepared in the same manner as Example 1, except for mixing 90 parts by weight of silicone oil KF-96 100cs (manufactured by Shin-Etsu Chemical Co., Ltd.), 10 parts by weight of silicone oil KF-96 200cs (manufactured by Shin-Etsu Chemical Co., Ltd.), and 30 parts by weight of toner particles 1.

Comparative Examples 1 to 3

The liquid developers are prepared with the compositions shown in Table 1 in the same manner as in Example 1. As paraffin oil in Comparative Example 2, P-70 (manufactured by MORESCO Corporation) is used.

Evaluation

Measurement of Content of Ammonium Ion

The toner particles are dispersed in water, are subjected to ultrasonic dispersion, ammonium ion is extracted to water, and then is analyzed by ion chromatography, and content of ammonium ion in toner is acquired. In detail, first, 0.5 g of toner particles is weighed in cap-attached 100 mL polyethylene bottle with a narrow opening (manufactured by Nalgene), 99.5 g of a dispersion containing 0.05% by weight of Triton X-100 in pure water is added thereto, dispersion is performed for 1 hour using an ultrasonic dispersing device (manufactured by AS ONE Corporation, USD-4R, 28 kHz) a temperature of which is controlled to 30±1° C., and then, the toner of the toner dispersion is separated using a syringe filter (manufactured by Toyo Roshi Kaisha, Ltd., HP020AN) to have an extracted solution. This extracted solution is analyzed by an ion chromatograph device (manufactured by Japan Dionex Corporation, ICS-2000) to acquire ammonium ion amount (ppm) of the toner. Analysis conditions of the ion chromatograph are as follows.

Cation ion separation column: IonPacCS12A manufactured by Japan Dionex Corporation Cation ion guard column: IonPacCG12A manufactured by Japan Dionex Corporation Eluent: methasulfonic acid 20 mM Flow rate: 1 mL/min Column temperature: 35° C.

Detection method: electrical conductivity (suppressor method)

Viscosity Evaluation

Shear velocity dependency of the viscosity when the shear velocity is changed is confirmed using the E-type viscometer. The shear velocity dependency of the viscosity of the liquid developer having the solid content concentration of 30% by weight when the shear velocity in a viscosity measurement mode is changed from 0.01 $s^{-1}$ to 1,000 $s^{-1}$, is confirmed using viscosity and viscoelasticity measuring device (MARS manufactured by HAAKE) and a cone plate having a diameter of 35 mm. A value of a low shear viscosity η at the shear velocity of 2 $s^{-1}$ is evaluated with the following criteria. The results thereof are shown in Tables 1 and 2.

A: $\eta \leq 2{,}000$ mPas

B: 2,000 mPas$<\eta\leq$4,000 mPas

C: 4,000 mPas$<\eta\leq$5,000 mPas

D: 5,000 mPas$<\eta$

Dispersibility Evaluation

Presence or absence of coarse powder of the dispersion of the developer is evaluated with the following criteria visually and by using a grind gauge having a gap of 15 μm (grind gauge 1509 manufactured by BYK). The results thereof are shown in Table 2.

A: Excellent dispersion is observed in both visual evaluation and the grind gauge evaluation.

B: aggregates are visually observed, but are not confirmed in grind gauge evaluation C: coarse powder is visually observed and coarse powder of 15 μm or larger is confirmed by the grind gauge.

Handleability Evaluation

Handleability when the developer is circulated inside of a silicone tube by using a pump, is evaluated as pipe fluidity when the developer is circulated inside of the silicone tube (inner diameter of 6.35 mm and a length of 9.53 mm) by using the pump (RP-1000 manufactured by EYELA). The handleability is evaluated with the following criteria. The results thereof are shown in Table 2.

A: no clogging occurs in the tube and the developer constantly stably circulates.

B: no clogging occurs in the tube and the developer circulates.

C: the developer flows through the tube initially but is unstable sometimes.

D: clogging occurs in the tube and the developer may not circulate.

Evaluation of Imaging Property and Image Storability

An image is output using the image forming apparatus shown in FIG. 1 and the evaluation of the image property and the image storability of the obtained image are performed. The results thereof are shown in Table 2.

The image property of the obtained image is evaluated with the following criteria.

A: excellent reproducibility of thin lines

B: partially poor reproducibility of thin lines

C: defects are observed in the image.

The obtained images are held for one month by overlapping each other, and the result thereof is evaluated as the image storability by the following criteria.

A: no change occurs in the image.

B: change such as gloss degradation is partially observed.

C: defects are observed in the image.

TABLE 1

| | Particle used | Volume average particle size [μm] | Ammonium ion amount [ppm] | Carrier liquid | Carrier liquid steady shear viscosity [mPas] | Developer low shear viscosity [mPas] |
|---|---|---|---|---|---|---|
| Example 1 | Toner particles 1 | 2.7 | 0.1 | Silicons oil 20CS | 17 | 2562 |
| Example 2 | Toner particles 2 | 3.0 | 0.005 | Silicone oil 20CS | 17 | 1800 |
| Example 3 | Toner particles 3 | 5.5 | 0.3 | Silicone oil 20CS | 17 | 2000 |
| Example 4 | Toner particles 4 | 0.9 | 0.09 | Silicone oil 20CS | 17 | 4683 |
| Example 5 | Toner particles 5 | 2.6 | 1 | Silicone oil 20CS | 17 | 3024 |
| Example 6 | Toner particles 1 | 2.7 | 0.1 | Silicone oil 1.5CS | 1 | 1688 |
| Example 7 | Toner particles 1 | 2.7 | 0.1 | Silicone oil 100CS | 100 | 4320 |
| Example 8 | Toner particles 1 | 2.7 | 0.1 | Silicone oil 0.65CS | 0.5 | 1564 |
| Example 9 | Toner particles 1 | 2.7 | 0.1 | Silicone oil 100CS: 0.9<br>Silicone oil 200CS: 01 | 110 | 4988 |
| Com. Ex. 1 | Toner particles 6 | 2.7 | 1.2 | Silicone oil 20CS | 17 | 5060 |
| Com. Ex. 2 | Toner particles 1 | 2.6 | 0.1 | Paraffin oil P-70 | 66 | 4488 |
| Com. Ex. 3 | Toner particles 7 | 2.7 | 0.002 | Silicone oil 20CS | 17 | 1532 |

TABLE 2

| | Viscosity | Dispersibility | Handleability | Image property | Image storability |
|---|---|---|---|---|---|
| Example 1 | B | A | A | A | A |
| Example 2 | A | B | A | A | A |
| Example 3 | A | A | A | B | B |
| Example 4 | C | B | B | B | A |
| Example 5 | B | A | B | B | A |
| Example 6 | A | A | A | A | A |
| Example 7 | C | A | B | A | A |
| Example 8 | A | A | A | B | B |
| Example 9 | C | A | B | A | B |
| Com. Ex. 1 | D | A | D | A | B |
| Com. Ex. 2 | C | A | D | A | C |
| Com. Ex. 3 | A | C | B | C | B |

The liquid developers of the examples have a low viscosity and excellent handleability, compared to the liquid developers of comparative examples. In addition, the liquid developers of the examples have excellent image property and image storability, compared to the liquid developers of comparative examples. Particularly, the liquid developers of Examples 1 and 2 have a small particle size and suitable particle size and ammonium ion amount, and therefore all of the handleability, the image property, and image storability are excellent. The liquid developer of Comparative Example 1 has relatively excellent image property and image storability, but the viscosity thereof is high, and accordingly the handleability is inferior. Since the liquid developer of Comparative Example 2 does not use silicone oil as the carrier, problems occur in the handleability and the image storability. The liquid developer of Comparative Example 3 has poor dispersibility, and accordingly problems occur in the image property and the image storability.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer comprising:

a carrier liquid having silicone oil; and toner particles including a polyester resin and having a value of ammonium ions contained therein measured by underwater extraction in a range of 0.005 ppm to 1 ppm.

2. The liquid developer according to claim 1, wherein the toner particles have a value of ammonium ions contained therein measured by underwater extraction in a range of 0.01 ppm to 0.5 ppm.

3. The liquid developer according to claim 1, wherein a volume average particle size of the toner particles is in a range of 1.0 μm to 5.0 μm.

4. The liquid developer according to claim 1, wherein a volume average particle size of the toner particles is in a range of 1.0 μm to 4.0 μm.

5. The liquid developer according to claim 1, wherein a volume average particle size of the toner particles is in a range of 1.0 μm to 3.0 μm.

6. The liquid developer according to claim 1, wherein steady shear viscosity of the silicone oil at 25° C. is in a range of 1 mPas to 100 mPas.

7. The liquid developer according to claim 1, wherein steady shear viscosity of the silicone oil at 25° C. is in a range of 1 mPas to 80 mPas.

8. The liquid developer according to claim 1, wherein steady shear viscosity of the silicone oil at 25° C. is in a range of 1 mPas to 60 mPas.

9. A liquid developer accommodation container comprising the liquid developer according to claim 1.

* * * * *